United States Patent [19]

Bolen

[11] 4,062,371

[45] Dec. 13, 1977

[54] WALKING CANE

[76] Inventor: Lawrence A. Bolen, 500 E. 33rd, Apt. No. 700, Chicago, Ill. 60616

[21] Appl. No.: 687,688

[22] Filed: May 19, 1976

[51] Int. Cl.[2] ..... A45B 3/04; F21V 33/00

[52] U.S. Cl. ..... 135/66; 135/DIG. 10; 320/3; 320/48; 362/102

[58] Field of Search ..... 135/66, DIG. 10; 240/6.42, 10.63; 320/2, 3, 48; 53/23 BA

[56] References Cited

U.S. PATENT DOCUMENTS

| | | | |
|---|---|---|---|
| 2,360,821 | 10/1944 | Aufiero | 320/2 |
| 2,435,650 | 2/1948 | Greene | 240/6.42 |
| 2,919,353 | 12/1959 | Paradise | 320/2 X |
| 2,951,163 | 8/1960 | Shaffer et al. | 320/2 X |
| 3,421,142 | 1/1969 | Kircher | 320/48 |
| 3,534,354 | 10/1970 | Galginaitis | 320/48 X |
| 3,746,961 | 7/1973 | Dobie | 320/48 |

FOREIGN PATENT DOCUMENTS

| | | | |
|---|---|---|---|
| 1,270,457 | 4/1972 | United Kingdom | 135/DIG. 10 |
| 192,354 | 8/1965 | U.S.S.R. | 135/DIG. 10 |

*Primary Examiner*—Werner H. Schroeder
*Assistant Examiner*—Conrad L. Berman
*Attorney, Agent, or Firm*—Robert D. Farkas

[57] ABSTRACT

This disclosure pertains to a walking cane, for use by the blind, having a portion of the shank thereof adapted with a solar cell. The current produced by the cell recharges a battery stored within the hollow interior portions of the cane. A lamp is selectively energized by operating a control switch. The lamp provides illumination, warning others of the disabled condition of the user. A buzzer or other alerting device is selectively included in the electrical circuit which enables the user to test the successful illumination of the lamp.

4 Claims, 2 Drawing Figures

WALKING CANE

BACKGROUND OF THE INVENTION

1. The Field of the Invention

This invention relates to walking canes and more particularly to that class having illumination means associated therewith.

2. Description of the Prior Art

The prior art abounds with illuminated walking canes. U.S. Pat. No. 3,336,469 issued on Aug. 15, 1967 to A. B. Barnes, Sr. et al teaches an illuminating lamp partially protruding outwardly from a hollow walking cane, powered by dry cell batteries, included within the hollow cane in a simple series circuit, with a control operating switch whose operating lever extends outwardly from the exterior surface of the cane.

U.S. Pat. No. 2,966,578 issued on Dec. 27, 1960 to D. J. Coffey discloses a battery operated flashlight assembly removably affixed to an umbrella or cane handle.

U.S. Pat. No. 2,642,519 issued on June 16, 1953 to W. Caustin et al concerns a luminiferous cane utilizing a battery operated lamp providing illumination to an elongated rod disposed along a portion of the shank of the cane, rendering the entire shank as an illuminated bar, easily discerned as a warning signal during night time use.

All of the aforementioned inventions suffer the common deficiency in failing to inform a blind user that the lamp is not successfully illuminated, and further, failing to provide illuminating power from a supply source other than a replaceable dry cell battery, whose useful life is limited.

SUMMARY OF THE INVENTION

A primary object of the present invention is to provide a lighted walking cane whose power source includes a battery which may be charged utilizing the rays of the sun, thereby requiring infrequent, if at all, battery replacements.

Another object of the present invention is to provide an illuminated cane which appeals to the user's sensory organs, other than his eyes, to indicate the effective operation of the illuminating lamp, thereby insuring that a blind man or user can rely upon an illuminated cane with a degree of certainty, that the cane is in fact, illuminated.

Still another object of the present invention is to provide an inexpensive and utilitarian walking implement which may be used in an unilluminated mode in the daytime.

Illuminated walking canes disclosed in the prior art rely upon batteries as the sole source of power to energize a lamp which signals the presence of a blind person or useful in illuminating the walkways and other darkened areas for those users who are not blind. Frequent battery replacement is required, and failing such replacement, the user is often-times confronted with the situation, during which, the lamp is inoperative when the need therefor is at its highest level. Furthermore, blind users are often times unaware that the lamp is inoperable due to the discharged condition of the battery, or other electrical malfunction. Accordingly, the instant invention overcomes these disadvantages by recharging the battery system during daylight hours, utilizing the sun's rays, and by providing the user with a non-visual test signal, informing him as to the status of the illumination provided by the lamp.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a cane having a hollow interior compartment. Stored within the compartment is a switch, a rechargeable battery, a light sensitive current generating cell, a portion of a lamp, and interconnecting wiring. The active face of the light responsive cell is responsive to light passing through an opening, capable of communicating light available outside the exterior surfaces of the cane to the active surface of the cell. In a reverse mode, the light producing portions of the lamp radiates illumination outwardly from the external surfaces of the cane, when energized. The rechargeable battery, deriving charging current from the cell. is utilized to provide energizing power to the lamp and selectively, to a buzzer. The switch is adapted with two operating positions, and an on-off position. The first operating position applies battery energy to a series circuit consisting of the lamp and the buzzer, thereby informing the user that the battery is charged and that the lamp filament and remaining circuitry is intact, sensibly signalling the illumination capabilities of the device. The second position is identical to the first circuit position, modified only by shorting out the buzzer element. In the second position, the lamp alone is illuminated, utilizing the rechargeable battery as a power source, as before. The circuit configuration, afforded by the first switch position, enables the user to constantly monitor the presence of illuminating current passing through the lamp filament, thus assuring him that the lamp and the associated circuitry is constantly providing an effective warning light, in those situations in which the user is absolutely dependent upon the presence of such a warning light. The second switch position may be utilized in less dangerous circumstances after the user has verified the effectiveness of the battery and lamp circuitry, as audibly informed by the buzzer in the first operating switch position.

Figure 1:
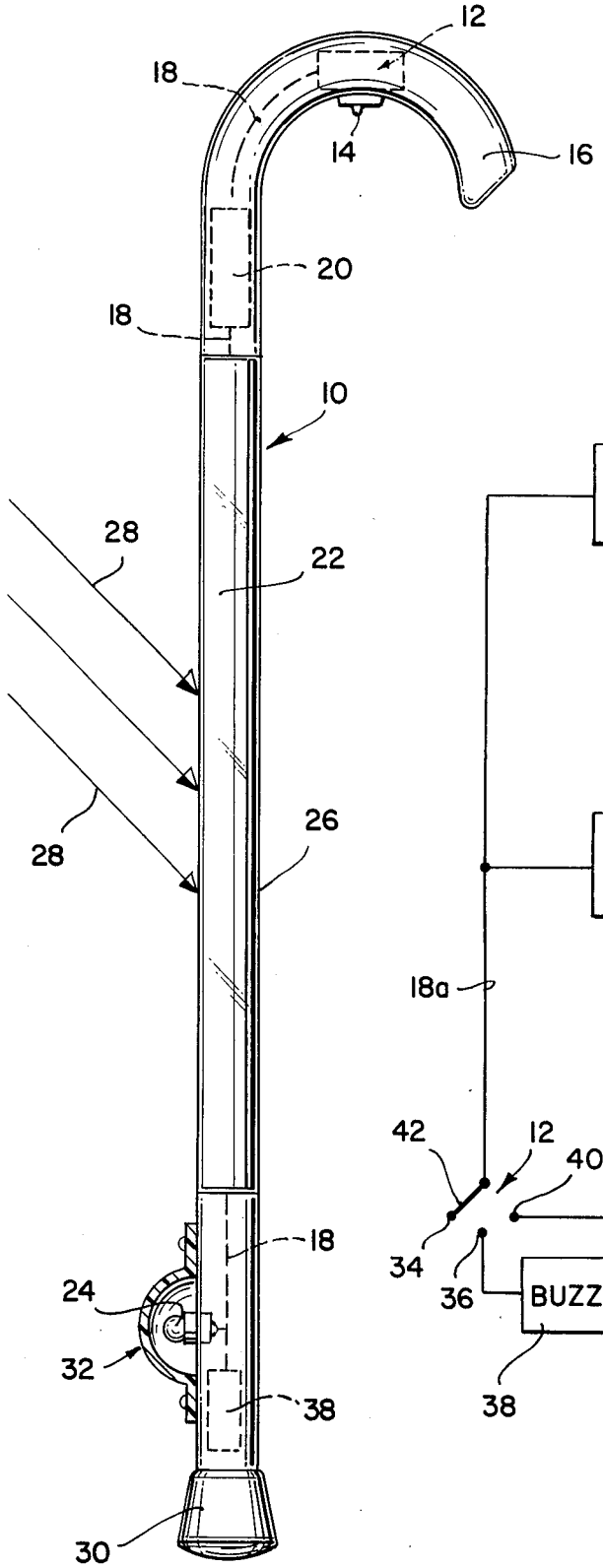
FIG. 1 is a side elevation view of the instant invention.

Now referring to the Figures, and more particularly to the embodiment illustrated in FIG. 1 showing a walking cane 10 having a switch element 12 contained within the hollow portions, not shown, thereof. A switch operating lever 14 extends outwardly from the exterior surface 16 of the cane. Wires 18, shown in dotted lines, electrically interconnect the switch element 12, a rechargeable electrical battery 20, a light activated current producing cell 22, and an electrical lamp 24. The cell is contained within an unbreakable glass cylinder 26, forming a portion of the exterior surface of the shank of cane 10. Light rays, denoted by arrows 28, impinge upon cell 22, after passing through glass tube 26, causing the cell to generate an output current. The output current is utilized to recharge battery 20.

Lamp 24, shown located adjacent rubber tip 30, may be positioned at any point along the structure of cane 10, and if desired, may be totally confined within glass tube 26. As shown, lamp 24 is guarded by a transparent plastic cover 32, removably affixed to the exterior surface of cane 10, thereby protecting the fragile glass portions of the lamp. Buzzer 38 is shown located within the cavity portions of the shank of cane 10, electrically connected to wires 18.

Figure 2:
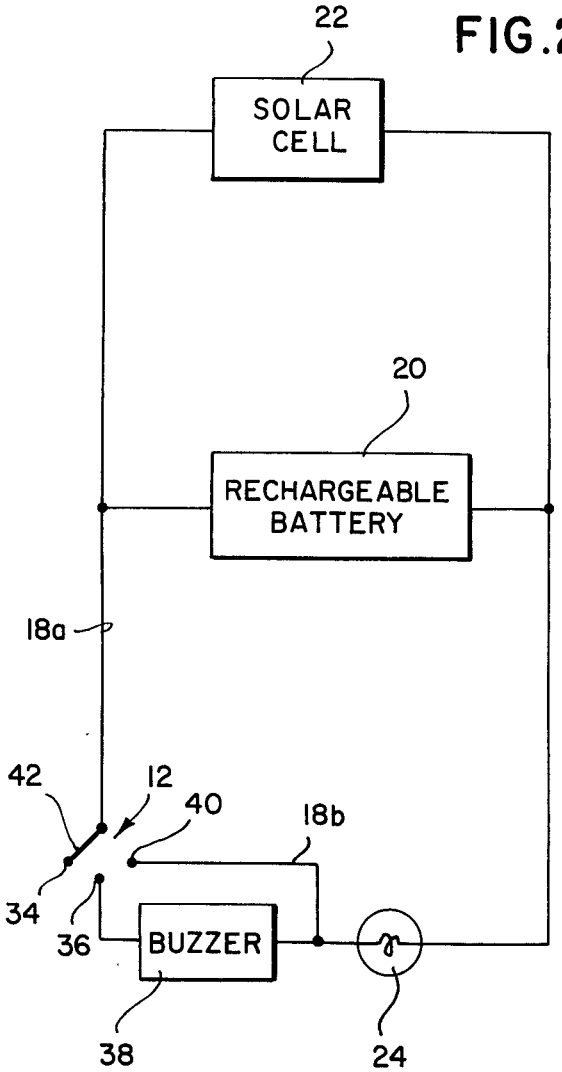
FIG. 2 is an electrical schematic of the electrical components utilized in the instant invention.

FIG. 2 illustrates cell 22 wired in a parallel circuit with rechargeable battery 20. Switch 12 is provided with contact terminals 34,36, and 40. When contact arm 42, of switch 12, is in touching engagement with contact 34, wire 18*a* does not have a current flow therethrough. When contact arm 42 is in a first operating switching position, in touching engagement with contact 36, a current flow passes through buzzer 38, lamp 24, and wire 18*a*. Such a current flow activates the buzzer whilst simultaneously illuminating the lamp. When contact arm 42 is in the second switch operating position, a current flow eminates from rechargeable battery 20 and passes through wires 18*a* and 18*b*, and through lamp 24. In this second operating switch position, lamp 24 alone is energized and buzzer 38 is effectively bypassed and remains silent.

One of the advantages of the present invention is a lighted walking cane whose power source includes a battery which may be charged utilizing the rays of the sun, thereby requiring infrequent, if at all, battery replacements.

Another advantage of the present invention is an illuminated walking cane which appeals to the user's sensory organs, other than his eyes, to indicate the effective operation of the illuminating lamp, thereby insuring that a blind man or user can rely upon an illuminated cane with a degree of certainty, that the cane is in fact, illuminated.

Still another advantage of the present invention is an inexpensive and utilitarian walking implement which may be used in an unilluminated mode in the daytime.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A walking cane comprising a rechargeable battery, light responsive means for electrically charging said rechargeable battery upon being exposed to light rays, a lamp, audible signalling means for electrically signalling the user that said rechargeable battery is in a charged condition and said lamp is electrically intact, switch means for selectively electrically allowing said rechargeable battery to energize said lamp and said audible signalling means simultaneously and for allowing said rechargeable battery to energize said lamp.

2. The walking cane as claimed in claim 1 wherein said light responsive means comprises an electrical cell, said cell producing an output current when said cell is exposed to visible light rays.

3. The walking cane as claimed in claim 2 wherein said switch means comprises said cell in a parallel electrical circuit with said rechargeable battery, said switch means including a switch having a first operating position and a second operating position, a first series circuit comprising said lamp and said buzzer and said switch when said switch is in said first operating position connected electrically in parallel with said rechargeable battery, a second series circuit comprising said lamp and said switch when said switch is in said second operating position connected electrically in parallel with said rechargeable battery, said switch means including a disconnected position wherein the terminals of said switch are in an open circuited position.

4. The walking cane as claimed in claim 1 wherein said walking cane further comprises a cavity, said rechargeable battery and said non-visual signalling means are housed within said cavity.

* * * * *